US006188307B1

(12) United States Patent
Katsuki et al.

(10) Patent No.: US 6,188,307 B1
(45) Date of Patent: Feb. 13, 2001

(54) THERMISTOR APPARATUS AND MANUFACTURING METHOD THEREOF

(75) Inventors: Takayo Katsuki, Shiga-ken; Takashi Shikama, Youkaichi, both of (JP)

(73) Assignee: Murata Manufacturing Co., Ltd., Nagaokakyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/063,303

(22) Filed: Apr. 21, 1998

Related U.S. Application Data

(62) Division of application No. 08/608,722, filed on Feb. 29, 1996, now Pat. No. 5,798,685.

(30) Foreign Application Priority Data

Mar. 3, 1995 (JP) ..... 7-43697

(51) Int. Cl.[7] ..... H01C 7/10

(52) U.S. Cl. ..... 338/22 R; 338/195; 338/225 D; 338/235

(58) Field of Search ..... 338/22 R, 225 D, 338/235, 195; 29/620

(56) References Cited

U.S. PATENT DOCUMENTS

| | | | | |
|---|---|---|---|---|
| 2,010,814 | * | 8/1935 | Ellis | 338/21 |
| 2,382,024 | * | 8/1945 | Priessman | 338/195 |
| 2,609,644 | * | 9/1952 | Brown, Jr. et al. | 338/195 |
| 3,768,157 | * | 10/1973 | Buie | 338/195 |
| 3,914,727 | * | 10/1975 | Fabricius | 338/22 R |
| 4,024,427 | | 5/1977 | Belhomme . | |
| 4,031,499 | | 6/1977 | Brueckner . | |
| 4,099,154 | * | 7/1978 | Bar | 338/22 R |
| 4,200,970 | * | 5/1980 | Schonberger | 29/593 |
| 4,210,800 | | 7/1980 | Van Bokestal et al. . | |
| 4,419,564 | | 12/1983 | Marcoux . | |
| 4,434,416 | | 2/1984 | Schonberger . | |
| 4,730,103 | | 3/1988 | Hawkins . | |
| 4,792,779 | * | 12/1988 | Pond et al. | 338/195 |
| 4,959,505 | | 9/1990 | Ott . | |
| 5,057,964 | * | 10/1991 | Bender et al. | 361/118 |
| 5,142,265 | * | 8/1992 | Motoyoshi et al. | 338/22 R |
| 5,218,336 | | 6/1993 | Murakami . | |
| 5,233,326 | | 8/1993 | Motoyoshi . | |
| 5,510,594 | * | 4/1996 | Mori et al. | 219/121.69 |
| 5,990,779 | * | 11/1999 | Katsuki et al. | 338/22 R |

FOREIGN PATENT DOCUMENTS

| | | |
|---|---|---|
| 1 193 756 | 9/1985 | (CA) . |
| 0 078 089 | 5/1983 | (EP) . |
| 2 099 220 | 12/1982 | (GB) . |
| 3-714701 | 7/1991 | (JP) . |
| 5-82305 | 4/1993 | (JP) . |
| 6-77007 | 3/1994 | (JP) . |
| WO 89/12309 | 12/1989 | (WO) . |

OTHER PUBLICATIONS

Patent Abstracts of Japan, vol. 017, No. 353 (E–1393), Jul. 5, 1993 & JP 05 055006 A (NGK Spark Plug Co Ltd), Mar. 5, 1993 (English Language Abstract).

* cited by examiner

*Primary Examiner*—Karl D. Easthom
(74) *Attorney, Agent, or Firm*—Burns, Doane, Swecker & Mathis, LLP

(57) ABSTRACT

A positive-characteristics thermistor apparatus has an insulating case, positive-characteristics thermistor devices, planar terminals, and spring terminals. Whichever thermistor device has a lower resistance of the two thermistor devices is trimmed to have a higher resistance which is near the resistance of the other thermistor device such that the two thermistor devices have substantially the same resistance (for example, within a difference of ±1 Ω). In other words, a part of an electrode of the thermistor device having a lower resistance is removed with a laser beam.

8 Claims, 5 Drawing Sheets

THERMISTOR APPARATUS AND MANUFACTURING METHOD THEREOF

This application is a divisional of application Ser. No. 08/608,722, filed Feb. 29, 1996, now U.S. Pat. No. 5,798, 685.

BACKGROUND OF THE INVENTION

1. Field of the Invention

The present invention relates to thermistor apparatuses and, more particularly, to an overcurrent-protection thermistor apparatus for protecting communications equipment such as telephone exchanges from overcurrent and to a manufacturing method thereof.

2. Description of the Related Art

Generally, an overcurrent-protection, positive-characteristics thermistor apparatus has been known. The known apparatus has one case in which two positive-characteristics thermistor devices are housed in order to protect communications equipment such as telephone exchanges from overcurrent, caused by lightning surges, contact with power lines or the like, intruding from communication lines. It is preferable that the difference in resistance between the two positive-characteristics thermistor devices is close to 0 Ω. This is because resistance matching needs to be maintained between the transmission and receiving circuit lines in communication circuits in communications equipment such as telephone exchanges.

In the conventional positive-characteristics thermistor apparatus, troublesome work has been required to make the difference in resistance between the two positive-characteristics thermistor devices close to 0 Ω. Selecting and pairing two positive-characteristics thermistor devices having substantially the same resistance among a number of positive-characteristics thermistor devices has been required. This work is made more complicated because positive-characteristics thermistor devices display large variations in resistance due to slight differences in manufacturing conditions.

A method can be considered in which positive-characteristics thermistor devices are classified into groups according to their resistances and then thermistor devices in a certain group are paired. If the resistance of each of the two positive-characteristics thermistor devices is measured at different times, however, the measurement data may not be accurate due to a change in the ambient temperature at each measurement or a minute change due to aging of the resistance measuring instrument, thereby the difference in resistance between the two combined thermistor devices can become large. In the worst case, resistance matching between the transmission and receiving circuit lines cannot be maintained.

Another method can be considered in which the resistance of each positive-characteristics thermistor device is measured and a device having a too-low resistance is trimmed to have a higher resistance such that all the thermistor devices have the specified resistance in the end. If the resistances of the two combined thermistor devices are measured at different times before they are trimmed, the measurement data may not be accurate due to the above-described reasons, making the difference in resistance measurements between the two thermistor devices inaccurate. Therefore, trimming cannot be conducted accurately and the resistance difference between the two thermistor devices can become large.

SUMMARY OF THE INVENTION

Accordingly, it is an object of the present invention to provide an easy-to-manufacture thermistor apparatus in which the two built-in thermistor devices have a small resistance difference and to provide a manufacturing method thereof.

The foregoing object is achieved in one aspect of the invention, through the provision of a thermistor apparatus comprising: an insulating case; two thermistor devices housed in the insulating case; and two pairs of terminals to bracket the two thermistor devices respectively, wherein either one having a lower resistance of the two thermistor devices is trimmed to have a higher resistance which is substantially the same as the resistance of the-other thermistor device.

The foregoing object is achieved in another aspect of the invention, through the provision of a manufacturing method of a thermistor apparatus, comprising the steps of: preparing an insulating case, two thermistor devices to be housed in the insulating case, and two pairs of terminals to bracket the two thermistor devices respectively; measuring the resistances of the two thermistor devices; and trimming whichever thermistor device has a lower resistance of the two thermistor devices to have a higher resistance which is substantially the same as the resistance of the other thermistor device.

The foregoing object is achieved in still another aspect of the invention, through the provision of a manufacturing method of a thermistor apparatus, comprising the steps of: preparing an insulating case, two thermistor devices to be housed in the insulating case, and two pairs of terminals to bracket the two thermistor devices respectively; measuring the resistances of the two thermistor devices substantially at the same time; and trimming whichever has a lower resistance of the two thermistor devices to have a higher resistance which is substantially the same as the resistance of the other thermistor device.

The foregoing object is achieved in a further aspect of the invention, through the provision of a manufacturing method of a thermistor apparatus according to the preceding paragraph, wherein, in a condition in which the two thermistor devices are housed in the insulating case, the resistances of the two thermistor devices are measured at substantially the same time, and whichever has a lower resistance of the two thermistor devices is trimmed to have a higher resistance which is substantially the same as the resistance of the other device having a higher resistance between the two thermistor devices.

The foregoing object is achieved in a still further aspect of the invention; through the provision of a manufacturing method of a thermistor apparatus according to the paragraph preceding the paragraph, wherein, in the condition in which the two thermistor devices are housed in the insulating case, the resistances of the two thermistor devices are measured at substantially the same time, and whichever has a lower resistance of the two thermistor devices is trimmed using a high-energy beam incident through an opening of the insulating case to have a higher resistance which is substantially the same as the resistance of the other thermistor device.

In the thermistor apparatus and the manufacturing method of a thermistor apparatus, trimming is only applied to one of the two thermistor devices and the other thermistor device needs not to be trimmed. Therefore, trimming work is halved compared with the conventional thermistor apparatus.

In the manufacturing method of a thermistor device, the resistances of the two thermistor devices can be measured nearly at the same time, hence such measurement is unlikely to be adversely influenced by effects caused by a change in the ambient temperature at the time of resistance measurement and a minute change by aging of the resistance measuring instrument. Therefore, the difference in resistance between the two thermistor devices is accurately measured and accurate trimming is applied to whichever thermistor device has a lower resistance.

In the manufacturing method of a thermistor device, since trimming as well as measuring resistance substantially at the same time are conducted when the two thermistor devices are stored in the same case, smooth assembling is performed and the occurrence of cracks or chips on the thermistor devices is reduced, preventing a change in resistance.

In the manufacturing method of a thermistor device, foreign matter is unlikely to enter the case since a high-energy beam is used in trimming, improving the reliability of the thermistor apparatus.

As a result of the present invention, an easy-to-manufacture thermistor apparatus having a small difference in resistance between the two built-in thermistor devices can be consistently obtained.

DETAILED DESCRIPTION OF THE PREFERRED EMBODIMENTS

Figure 1:
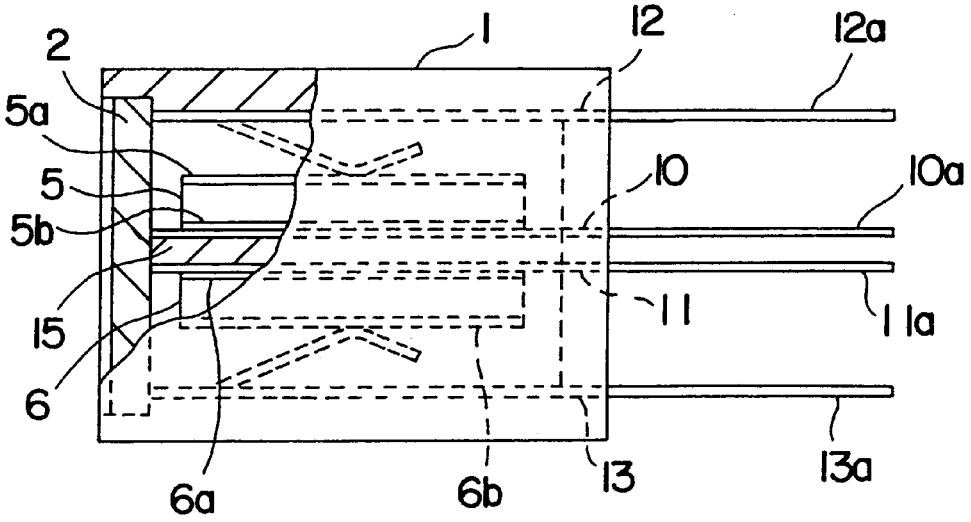
FIG. 1 is a partially broken elevation illustrating a first embodiment of a thermistor apparatus and a manufacturing method thereof according to the present invention.

Preferred embodiments of a thermistor apparatus and a manufacturing method thereof according to the present invention will be described below by referring to the drawings.

Figure 2:
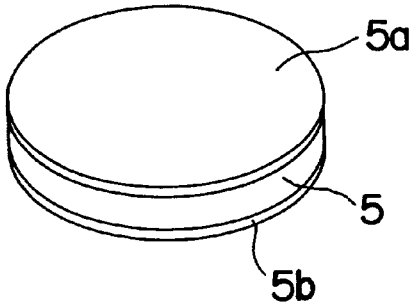
FIG. 2 is a perspective view of one of two thermistor devices used in the thermistor apparatus shown in FIG. 1.
Figure 3:
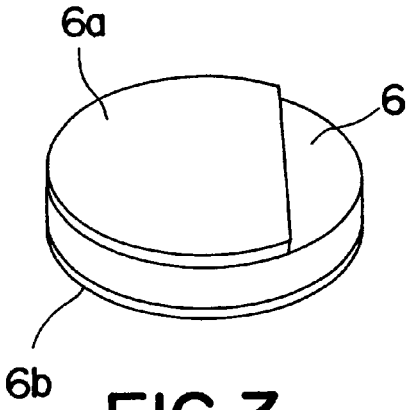
FIG. 3 is a perspective view of the other one of the two thermistor devices used in the thermistor apparatus shown in FIG. 1.

First Embodiment (FIGS. 1 to 3)

As shown in FIG. 1, a positive-thermistor apparatus comprises an insulating case 1, a lid member 2, two positive-characteristics thermistor devices 5 and 6, two planar terminals 10 and 11, two spring terminals 12 and 13, and an insulating plate 15.

The insulating case 1 is closed at the left-hand opening with the lid member 2. Materials used for the insulating case 1 and the lid member 2 include thermosetting resin such as phenol and thermoplastic resin such as polyphenylene sulfide.

The positive-characteristics thermistor devices 5 and 6 have circular shapes as shown in FIGS. 2 and 3 and are made from ceramics such as BaTiO3. The thermistor devices 5 and 6 have electrodes 5*a*, 5*b*, 6*a*, and 6*b* at the respective front and rear surfaces. Whichever has a lower resistance of the two thermistor devices is trimmed to have a higher resistance such that its resistance is near the resistance of the other device, i.e., such that the two thermistor devices 5 and 6 have substantially the same resistance (for example, within a difference of ±1 Ω). In the first embodiment, part of the electrode 6*a* of the thermistor device 6 is removed by laser trimming as shown in FIG. 3.

The insulating plate 15 is interposed between the two thermistor devices 5 and 6 and it is made from a material having a good thermal conductivity and is formed integrally with the insulating case 1, for example.

The planar terminals 10 and 11 are disposed between the insulating plate 15 and the thermistor device 5, and between the insulating plate 15 and the thermistor device 6, respectively. One planar terminal 10 touches a major surface of the insulating plate 15 and the electrode 5*b* of the thermistor device 5. The other planar terminal 11 touches the other wall surface of the insulating plate 15 and the electrode 6*a* of the thermistor device 6. One end 10*a* and 11*a* of both of the planar terminals 10 and 11 protrudes from the case 1 as shown at the right of FIG. 1.

The spring terminals 12 and 13 are disposed between the case 1 and the thermistor device 5, and the case 1 and the thermistor device 6, respectively. The spring terminal 12 touches an inner surface of the case 1 and the electrode 5*a* of the thermistor device 5, and the spring terminal 13 touches an inner surface of the case 1 and the electrode 6*b* of the thermistor device 6. One end 12*a* and 13*a* of both of the spring terminals 12 and 13 protrudes from the case 1 as shown at the right of FIG. 1.

The two thermistor devices 5 and 6 are held by the terminals 12 and 13 with pressure applied in the devices' thickness direction. When in the case 1 is sealed with the lid member 2, the thermistor devices 5 and 6 sandwich or bracket the planar terminals 10 and 11 and the insulating plate 15. The thermistor devices 5 and 6 are electrically insulated from each other by the insulating plate 15. The thermistor devices 5 and 6 are closely thermally-connected to each other through the insulating plate 15 and the planar terminals 10 and 11.

A procedure for reducing the difference in resistance between the two positive-characteristics thermistor devices 5 and 6 in the positive-characteristics thermistor apparatus having the structure described above will be described in detail below.

Among a plurality of prepared positive-characteristics thermistor devices, two positive-characteristics thermistor devices 5 and 6 are selected and their resistances are measured with a resistance measuring instrument. It is preferred that the resistances of the two thermistor devices 5 and 6, which are to be stored in the same case, are measured at nearly the same time.

This avoids adverse effects caused by a change in the ambient temperature at the time of resistance measurements and by a minute change by aging of the resistance measuring instrument, thereby the difference in resistance between the two thermistor devices 5 and 6 is accurately measured to conduct accurate trimming in a subsequent process.

The accurately measured resistance data is sent to a calculation processing unit. An electrode area to be removed from whichever thermistor device has a lower resistance between the two thermistor devices (e.g., in the first illustrated embodiment, the thermistor device 6) is calculated from the resistance difference between the two thermistor devices 5 and 6. Then, according to the electrode area to be removed, a drive signal is sent from the calculation processing unit to a laser trimming unit. The laser trimming unit emits a laser beam to trim the thermistor device 6, which has a lower resistance in this example. In other words, a part of the electrode 6*a* is removed and the whole area of the electrode is reduced by the specified area. The thermistor device 6 in which part of the electrode 6*a* has been removed has a higher resistance than before, and is now substantially the same as that of the other thermistor device 5. Trimming can be conducted in two or more steps. The resistances of the thermistor devices may be measured subsequent to a first trimming, and trimming may be conducted again depending on the results of the first measurement.

The two positive-characteristics thermistor devices 5 and 6 which have a small resistance difference are thus obtained. Since trimming is only applied to the thermistor device 6, which has a lower resistance, trimming work is halved compared with the conventional method in which trimming is applied to both thermistor devices.

Second Embodiment (FIGS. 4 to 8)

Figure 4:
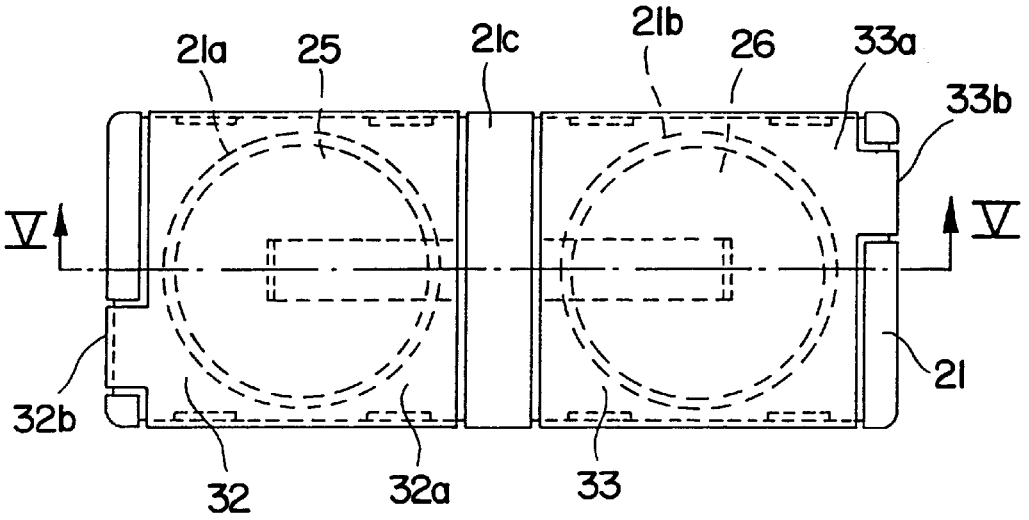
FIG. 4 is a plan illustrating a second embodiment of a thermistor apparatus and a manufacturing method thereof according to the present invention.
Figure 5:
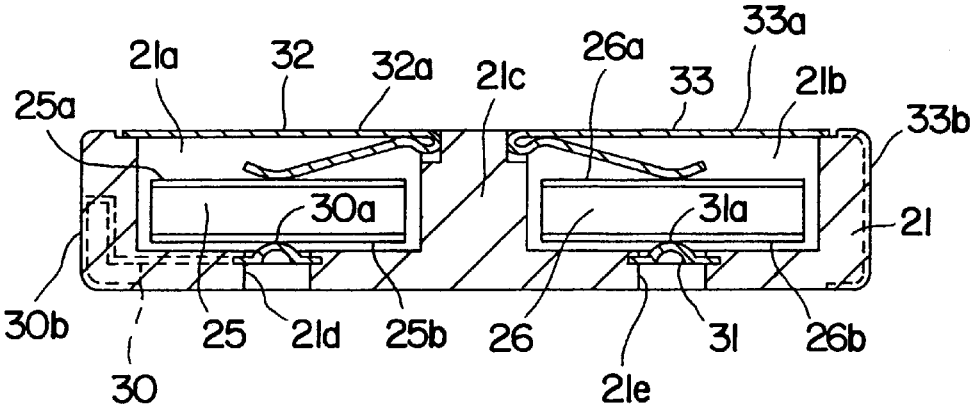
FIG. 5 is a partial cross-section taken along line V—V of FIG. 4.

As shown in FIGS. 4 and 5, a positive-characteristics thermistor apparatus comprises an insulating case 21, two positive-characteristics thermistor devices 25 and 26, two protruding terminals 30 and 31, and two spring terminals 32 and 33.

The insulating case 21 has a partition 21*c* at its center and two circular cavities 21*a* and 21*b* disposed to the left and to the right of the partition within a plane.

The thermistor devices 25 and 26 have circular shapes and are provided with electrodes 25*a*, 25*b*, 26*a*, and 26*b* at the respective front and rear surfaces. Whichever has a lower resistance of the two thermistor devices is trimmed to have a higher resistance. The higher resistance of the trimmed thermistor is near the resistance of the other device such that the two thermistor devices 25 and 26 have substantially the same resistance (for example, within a difference of ±1 Ω).

The protruding terminals 30 and 31 are insert-molded in the case 21 and are provided with protrusions 30*a* and 31*a* at their centers. The protrusions 30*a* and 31*a* project through holes 21*d* and 21*e* provided at the bottom of the case 21, and touch electrodes 25*b* and 26*b* of the thermistor devices 25 and 26, respectively. The other ends of the protruding terminals 30 and 31 extend along the left and right side faces of the case 21 and folded on the surface of the case 21 to form external-connection portions 30*b* and 31*b*.

The spring terminals 32 and 33 comprise electrodes 32*a* and 33*a* and external connection portions 32*b* and 33*b*. The electrodes 32*a* and 33*a* are disposed on the upper surface of the case 21 and cover the openings of the cavities 21*a* and 21*b*. The external-connection portions 32*b* and 33*b* are folded along the surface of the case 21 to extend to the bottom surface by way of the left and right side faces of the case 21. To increase the seal at the openings of the cavities 21*a* and 21*b*, another lid may be used to cover the openings.

The two thermistor devices 25 and 26 are sandwiched or bracketed by the protruding terminals 30, 31 and the spring terminals 32, 33 in the cavities 21*a* and 21*b*, respectively, and held with pressure in the direction of the thickness of the thermistor devices.

A procedure for manufacturing the thermistor apparatus having the structure described above will be described by referring to FIGS. 6 to 8.

Figure 6:
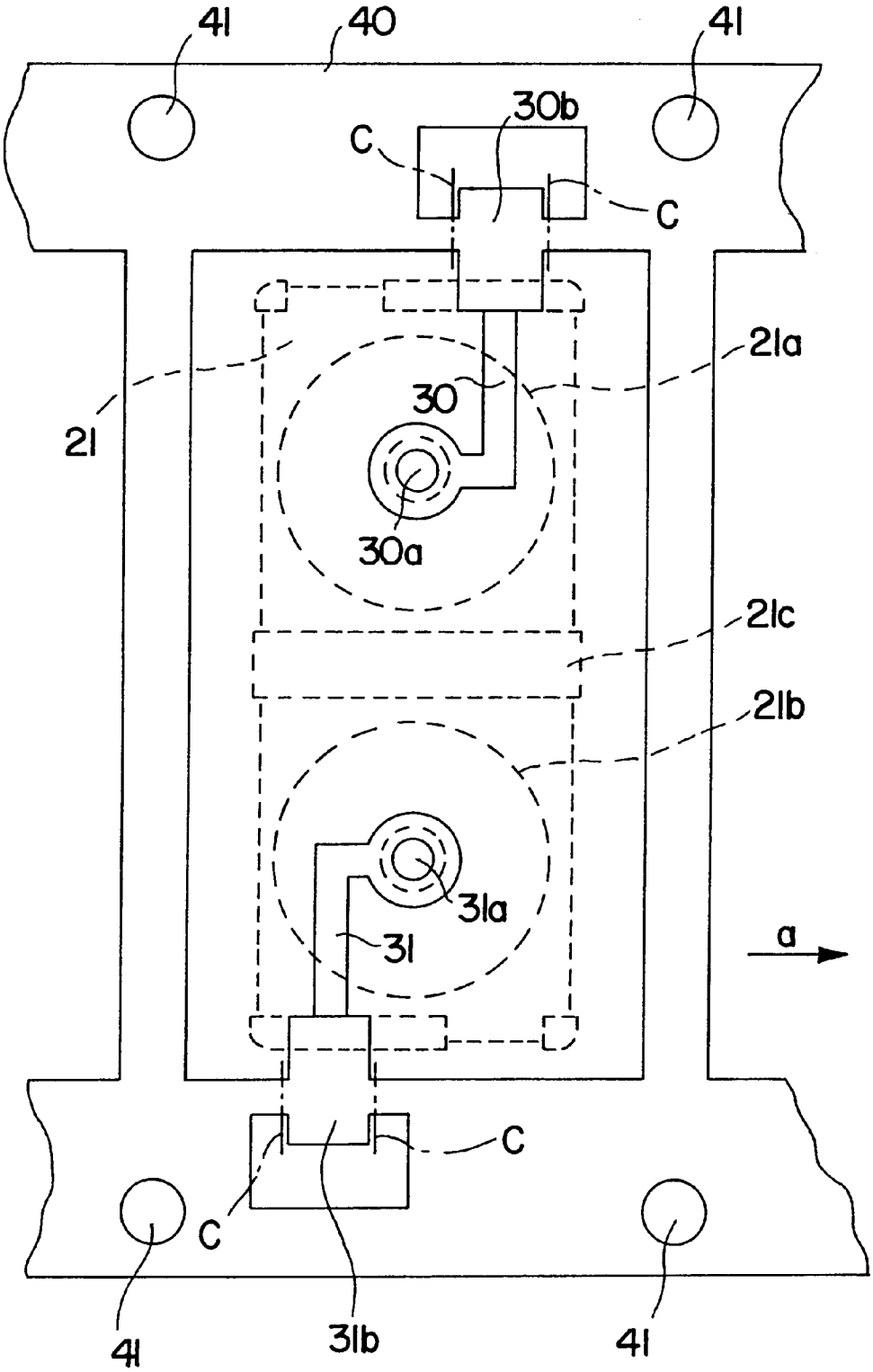
FIG. 6 is a plan showing processes of a manufacturing method of the thermistor apparatus illustrated in FIG. 4.

A hoop material 40 on which the protruding terminals 30 and 31 are connected is prepared by punching a strip-shaped metal plate as shown in FIG. 6. The hoop material 40 is provided with feed holes 41 at both edges and transferred using these holes in the direction indicated by arrow "a" to each process. Therefore, assembling and trimming can be conducted in one line as will be described later, thereby facilitating automation of the manufacturing process.

The protruded terminals 30 and 31 are insert-molded with resin. The case 21 is formed, with the protrusions 30*a* and 31*a* and the external-connection portions 30*b* and 31*b* being exposed.

Figure 7:
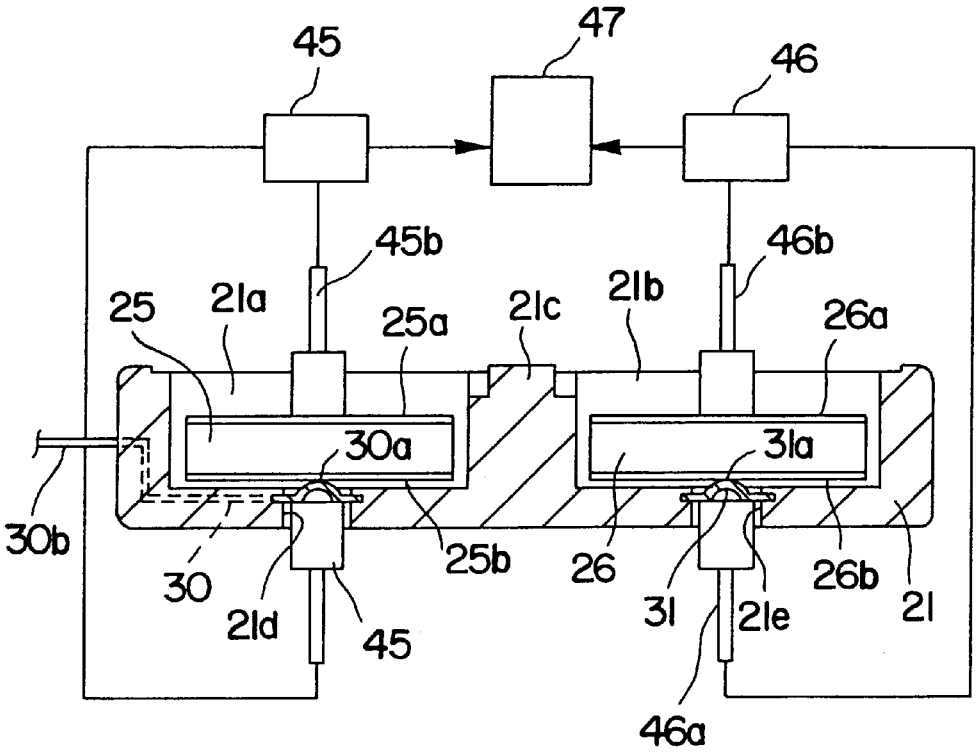
FIG. 7 is a partial cross-section showing processes of the manufacturing method subsequent to those shown in FIG. 6.
Figure 8:
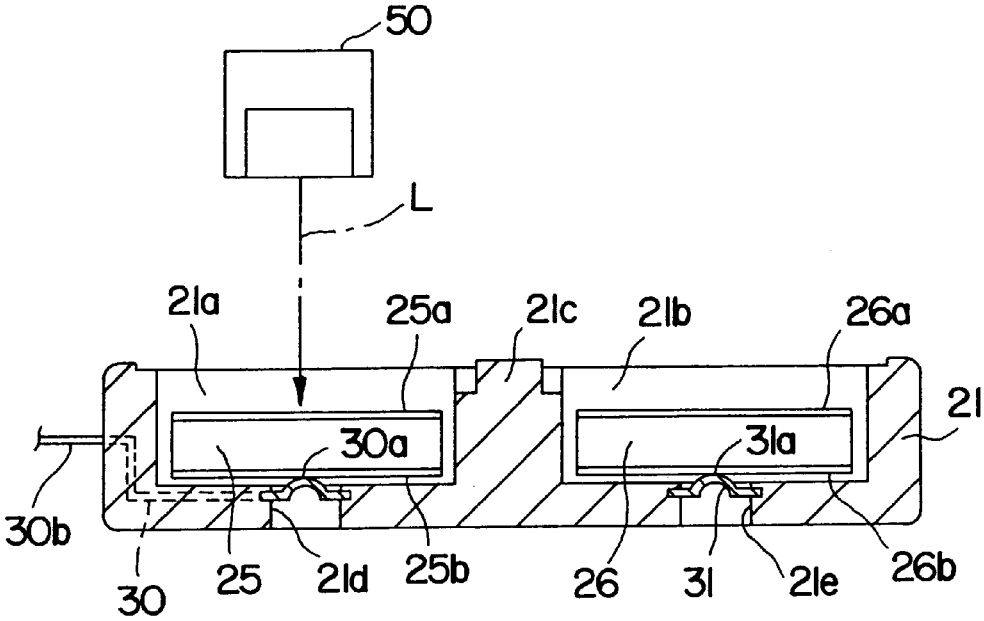
FIG. 8 is a partial cross-section showing processes of the manufacturing method subsequent to those shown in FIG. 7.

The thermistor devices 25 and 26 are inserted horizontally into the cavities 21*a* and 21*b* of the case 21, as shown in FIG. 7. One measuring terminal 45*a* of a resistance measuring instrument 45 is inserted into a first hole 21*d* of the case 21 to touch a first protruding terminal 30. The other measuring terminal 45*b* is also inserted into a first cavity 21*a* to touch the first spring electrode 25*a*. In the same way, one measuring terminal 46*a* of a second resistance measuring instrument 46 touches a second protruding terminal 31 and the other measuring terminal 46*b* touches a second electrode 26*a*. Then the resistances of the thermistor devices 25 and 26 are measured at the same time to avoid adverse effects caused by a change in the ambient temperature on resistance measurement and a minute change by aging of the resistance measuring instruments 45 and 46. Therefore, the difference in resistance between the two thermistor devices 25 and 26 is accurately measured to conduct accurate trimming in a subsequent process.

The measured, accurate resistance data is sent to a calculation processing unit 47 and an electrode area to be removed from whichever has a lower resistance between the two thermistor devices 25 and 26 (in the second embodiment, the left thermistor device 25 as shown in FIG. 4) is calculated from the resistance difference between the two thermistor devices. Then, according to the electrode area to be removed, a drive signal is sent from the calculation processing unit 47 to a laser trimming unit 50. The laser trimming unit 50 emits a laser beam L to trim the thermistor device 25, which has a lower resistance. In other words, a part of the electrode 25*a*, which is exposed through the opening portion of the cavity 21*a*, is removed and the whole area of the electrode is reduced by the specified area. The thermistor device 25 in which part of the electrode 25*a* has been removed has a higher resistance than before, the higher resistance being substantially the same as that of the other thermistor device 26.

The two positive-characteristics thermistor devices 25 and 26 which have a small resistance difference are thus obtained. Since trimming is only applied to the thermistor device 25 which has a lower resistance, trimming work is halved compared with that for the conventional method in which trimming is applied to both thermistor devices. Since trimming as well as measuring resistance is conducted in the condition in which the thermistor devices 25 and 26 are housed in the case 21, smooth assembling can be performed and changes in resistance of the thermistor devices 25 and 26 due to cracks or chips occurring when the devices are handled can be prevented. Furthermore, foreign matter is unlikely to enter the case 21 since laser trimming is used.

The spring terminals 32 and 33 are disposed at the openings of the cavities 21*a* and 21*b* in the case 21. Their external-connection portions 32*b* and 33*b* are folded along the surface of the case 21. Then, the positive-characteristics thermistor apparatus is taken out of the hoop material 40 by cutting the hoop material alone a dot-and-dash line C shown in FIG. 6. The external-connection portions 30*b* and 31*b* of the protruded terminals 30 and 31 are folded along the surface of the case 21 to finish assembling the apparatus.

A thermistor apparatus and a manufacturing method thereof according to the present invention is not limited to the foregoing embodiments. Within the scope of the invention, they can be modified in various manners.

For instance, the thermistor apparatus using the positive-characteristics thermistor devices is described in the foregoing embodiments. The thermistor apparatus may use negative-characteristics thermistor devices.

Figure 9:
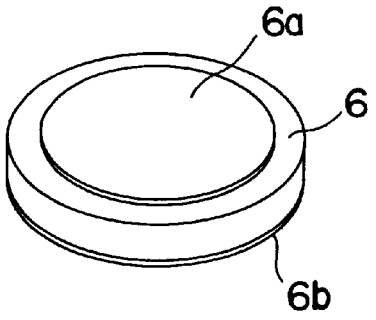
FIG. 9 is a perspective view of a thermistor device used for a thermistor apparatus according to another embodiment.
Figure 10:
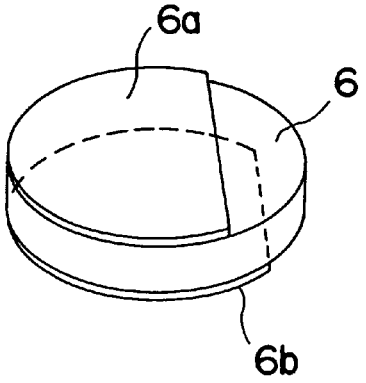
FIG. 10 is a perspective view of a thermistor device used for a thermistor apparatus according to still another embodiment.
Figure 11:
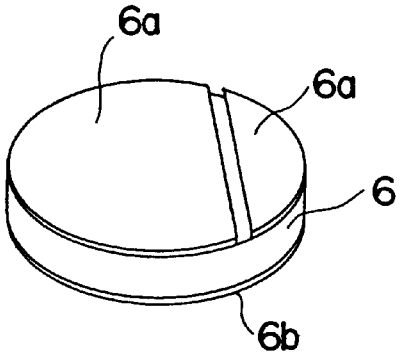
FIG. 11 is a perspective view of a thermistor device used for a thermistor apparatus according to yet another embodiment.
Figure 12:
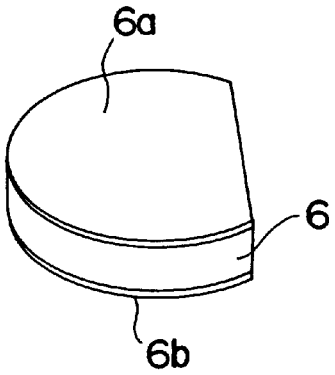
FIG. 12 is a perspective view of a thermistor device used for a thermistor apparatus according to a further embodiment.

An area removed from an electrode of the thermistor in trimming can have any shape. As shown in FIG. 9, for example, a circumferential area of the electrode 6*a* may be removed. Part of the upper electrode 6*a* and part of the lower electrode 6*b* may be removed as shown in FIG. 10. Alternatively, the electrode 6*a* may be divided into two sections as shown in FIG. 11. Part of the thermistor body can be removed together with the upper and lower electrodes 6*a* and 6*b*.

A laser beam is used in trimming in the foregoing embodiments. A high-energy beam, such as an electronic beam or an ion beam, can be used instead of the laser beam.

The electrodes have a single layer in the foregoing embodiments. However, the electrodes may have multiple layers.

The above described embodiments are illustrative of the present invention which is not limited to these embodiments. The scope of the invention is to be determined by the claims appended hereto.

What is claimed is:

1. A thermistor apparatus comprising:

an insulating case;

two thermistor devices housed in said insulating case, wherein each of said two thermistor devices includes a ceramic body having a front surface and a rear surface and substantially planar electrodes comprised of electrode material on respective said front and said rear surfaces, and wherein said two thermistor devices have the same resistance, but only one of said two thermistor devices has had electrode material removed from one of said front surfaces; and two pairs of terminals, wherein in each pair of terminals one terminal is connected to said front surface of a respective thermistor device and the other terminal is connected to said rear surface of a respective thermistor device, and wherein said insulating case includes openings configured to permit interaction with external electrode material removing means for removal of electrode material from at least one of said two thermistor devices when a respective said one terminal, each of which forms a separate top cover of said case over each respective thermistor is not in place, and further wherein each of said separate top covers has a substantially planar cover portion over one of said openings and is substantially parallel to and facing said one of said front surfaces.

2. The thermistor apparatus in accordance with claim 1, wherein said two thermistor devices are housed in said insulating case and said rear surfaces of said two thermistor devices are in a single plane such that the two thermistor devices are side-by-side in said insulating case.

3. The thermistor apparatus in accordance with claim 1, wherein at least one terminal of said two pairs of terminals covers the entire front surface of a respective thermistor device, and exposes the entire front surface of said thermistor device when said at least one terminal is not in place.

4. The thermistor apparatus in accordance with claim 1, wherein said insulating case includes a cavity having an opening larger than the diameter of at least one of said two thermistor devices.

5. A thermistor apparatus comprising:

an insulating case;

two thermistor devices housed in said insulating case, wherein each of said two thermistor devices includes a ceramic body having a front surface and a rear surface and substantially planar electrodes comprised of electrode material on respective said front and said rear surfaces, and wherein said two thermistor devices have the same resistance, but only one of said two thermistor devices has had electrode material removed from one of said front surfaces; and two pairs of terminals, wherein in each pair of terminals one terminal is connected to said front surface of a respective thermistor device and the other terminal is connected to said rear surface of a respective thermistor device, and wherein said insulating case includes at least one opening to expose the front surface of the respective thermistor device when the respective said one terminal, each of which forms a separate top cover of said case over each respective thermistor, is not in place through which electrodes of a resistance measuring unit can be selectively inserted to make contact with at least one of said two thermistor devices, and further wherein each of said separate top covers has a substantially planar cover portion over one of said openings and is substantially parallel to and facing said one of said front surfaces.

6. The thermistor apparatus in accordance with claim 5, wherein said two thermistor devices are housed in said insulating case and said rear surfaces of said two thermistor devices are in a single plane such that the two thermistor devices are side-by-side in said insulating case.

7. The thermistor apparatus in accordance with claim 5, wherein at least one terminal of said two pairs of terminals covers the entire front surface of a respective thermistor device, and exposes the entire front surface of said thermistor device when said at least one terminal is not in place.

8. The thermistor apparatus in accordance with claim 5, wherein said insulating case includes a cavity having an opening larger than the diameter of at least one of said two thermistor devices.

* * * * *